United States Patent [19]

Thalmann

[11] 3,946,792

[45] Mar. 30, 1976

[54] METHOD OF OPERATING A CONTINUOUS CASTING INSTALLATION WITH COMPENSATION OF DEVIATIONS IN WATER VAPOR PRESSURE

[75] Inventor: Armin Thalmann, Uster, Switzerland

[73] Assignee: Concast AG, Zurich, Switzerland

[22] Filed: Dec. 3, 1973

[21] Appl. No.: 421,085

[30] Foreign Application Priority Data

Dec. 5, 1972 Switzerland ..... 17771/72

[52] U.S. Cl. ..... 164/4; 164/89; 164/154; 164/282; 164/283 R; 164/283 S

[51] Int. Cl.[2] ..... B22D 11/124

[58] Field of Search ..... 164/4, 82, 89, 154, 282, 164/283 R, 283 S

[56] References Cited

UNITED STATES PATENTS

| | | | |
|---|---|---|---|
| 894,410 | 7/1908 | Trotz | 164/282 |
| 2,747,245 | 5/1956 | Junghans | 164/89 |
| 3,658,117 | 4/1972 | Fromson | 164/89 |
| 3,759,312 | 9/1973 | Mizikar et al. | 164/89 X |
| 3,848,656 | 11/1974 | Meylan | 164/89 |

FOREIGN PATENTS OR APPLICATIONS

| | | | |
|---|---|---|---|
| 725,586 | 1/1966 | Canada | 164/89 |

*Primary Examiner*—R. J. Shore
*Attorney, Agent, or Firm*—Werner W. Kleeman

[57] ABSTRACT

A method of operating a continuous casting installation with high throughput wherein a metal, typically steel, is cast into a cooled continuous casting mold, withdrawing from the mold the cast strand possessing a liquid core and which is formed in such mold, guiding and cooling the withdrawn strand. At least in a partial zone between the mold and the complete solidification of the strand the strand surface is subjected to the action of a pressurized gaseous medium, primarily in the form of water vapor, the pressure of the gaseous medium essentially corresponding to the ferrostatic pressure prevailing in the strand, the water vapor being generated by spraying the strand surface with water, and deviations in the vapor pressure from the required vapor pressure are compensated.

5 Claims, 1 Drawing Figure

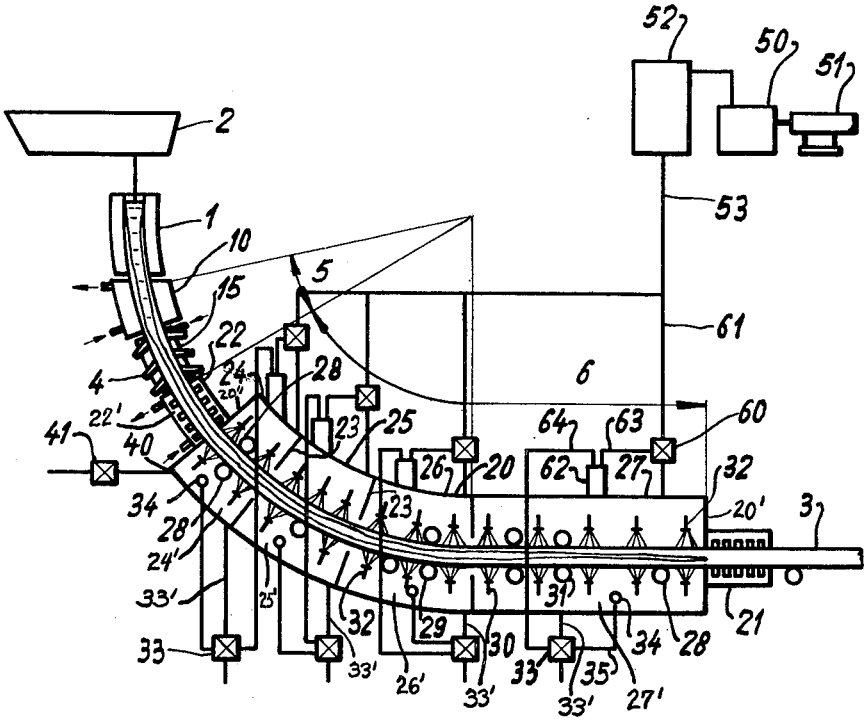
52
50
51
2
53
1
10
5
15
61
22
6
4
24
28
22'
23
25
64
63
60
41
40
26
20
62
27
32
34
23
20'
3
28'
24'
33'
25'
31
21
32
29
30
34
28
33
33'
26'
33'
33
35
27'
33'

METHOD OF OPERATING A CONTINUOUS CASTING INSTALLATION WITH COMPENSATION OF DEVIATIONS IN WATER VAPOR PRESSURE

BACKGROUND OF THE INVENTION

The present invention relates to a new and improved method of operating a continuous casting installation with high capacity or throughput and also pertains to a new and improved construction of continuous casting installation for the performance of the aforesaid method.

During the continuous casting of steel, the strand emanating from the essentially vertically arranged continuous casting mold, and which strand possesses an outer shell or skin and a long liquid core, normally is guided and simultaneously cooled at a roller apron along a desired path of travel into a horizontal path of travel. By means of a withdrawal and straightening apparatus the strand is conveyed and straightened. The ferrostatic pressure acting upon the shell of the strand is taken-up by the rollers.

In the case of continuous casting installations operating at high throughput, that is to say, with continuous casting speeds exceeding 1 meter per minute for the casting of large slab cross-sections, there are required rollers of large diameter for supporting the forces acting upon the strand shell owing to the ferrostatic pressure. Thus, at the region following the continuous casting mold, that is to say, at the region of the strand which still has a thin outer shell or skin, it is not possible to prevent bulging thereof owing to the large distances between the supports and the absence of longitudinal supports between the rolls or rollers. This bulging produces the well known metallurgical defects, such as fissures and the like, which can also lead to metal breakout. Furthermore, a large withdrawal force is necessary since such bulging portions of the strand again must be pressed back by the rollers to the adjusted rated value.

In order to avoid such bulging between the rollers with higher casting speeds, it is known in this particular field of technology to arrange cooling plates and/or cooling grids at the region of the still thin strand shell or skin.

According to an unpublished proposal, the drawbacks of the bulging phenomenon arising at strands with large cross-sections at continuous casting installations operating with high throughput or capacity, for instance with casting speeds in the order of 2 meters per minute and more, are intended to be avoided in that the surface of the strand between the mold and the location of the complete solidification of the strand is subjected to pressurized water vapor. There is required for this purpose a pressure compartment arranged about the strand. The water vapor is generated by spraying water onto the surface of the strand. Since the ferrostatic pressure changes at the curved portion, the pressure compartment is subdivided at this region or portion, so that it is possible to approximately adjust the counter-pressure corresponding to the momentary ferrostatic pressure.

When the machine or continuous casting installation is cold, i.e., during interruptions in the casting operation, generating the required vapor pressure is associated with difficulties. Maintaining the machine in a warm condition or pre-heating the machine is associated with considerable costs.

If there is chosen the procedure of pre-heating the casting machine, then the machine is not operationally ready at all times because pre-heating requires a considerable amount of time. During disturbances in the casting operation, when exchanging the ladle during sequential pours, or at the end of casting with the therewith required reduction in the casting speed, the pressure in the compartment varies, producing damage at the solidified marginal zone with inclusions of water or vapor throughout the liquid steel and thus promoting the danger of explosions.

SUMMARY OF THE INVENTION

It is therefore a primary object of the present invention to provide an improved method of operating a continuous casting installation and an improved continuous casting installation for the performance of the aforesaid method which are not associated with the previously discussed drawbacks prevailing in the art.

Another and more specific object of this invention aims at realizing an operational readiness of the continuous casting installation working at high throughput at any moment in time and preventing the pressure fluctuations in the pressurized compartment which endanger the casting operation.

Now in order to implement these and still further objects of the invention, which will become more readily apparent as the description proceeds, the invention contemplates that the liquid metal, typically steel, is cast into a cooled continuous casting mold, the strand which is formed and possessing a liquid core is withdrawn from the mold, guided and cooled. At least in a partial zone or region between the mold and complete solidification of the strand, the strand surface is subjected to a pressurized gaseous medium, primarily in the form of water vapor, the pressure of the gaseous medium essentially corresponding to the ferrostatic pressure prevailing in the strand, the water vapor being produced by spraying the strand surface with water, and deviations from the required or predetermined vapor pressure are compensated.

This installation which operates at a high casting throughput or capacity is ready for operation at any moment in time. There are no costs, as are necessary with the prior art proposals, for pre-heating and maintaining the installation in a heated state. Deviations from the required pressure which are brought about due to operation of the installation, for instance owing to reduced heat transfer by the strand, together with its deleterious effects for the outer shell or skin of the strand, can be effectively avoided.

As previously indicated the invention is not only concerned with the aforementioned method aspects but also with a new and improved construction of continuous casting installation for the performance of such method which comprises a casting or pouring vessel, a cooled mold and following such mold a strand guide assembly with cooling means. A partial region or zone of the strand guide assembly is equipped with a closed or sealed pressurized compartment provided at its ends with means for sealing the throughpassing strand. Rollers for guiding the strand along a predetermined path and devices for conveying as well as spraying the strand are arranged within such compartment. There is also provided means for compensating for pressure deviations.

Upon dropping below the required vapor pressure, for instance during insufficient heat transfer through the strand, the prevailing difference is compensated by the infeed of pressurized or compressed air.

By means of the waste heat of the strand an excess pressure can exist in a given one or a number of individual compartments. In such cases, upon exceeding the required or predetermined vapor pressure the difference is compensated by lowering the level of the cooling water in a collecting basin, and the signal of a level feeler or sensor for the level of the cooling water can be rendered ineffectual.

To compensate for deviations below the required vapor pressure there is provided a device for producing compressed or pressurized air and consisting of a blower, for instance an axial blower, with associated storage vessel or reservoir, whereby the latter serves for delivering the pressurized or compressed air until a supply of pressurized air can be produced by the axial blower which starts to run.

The device for compensating the necessary pressure consists of a pressure feeler having three threshold values, an electromagnetic valve for the infeed of pressurized air and a motor valve for the withdrawal of the cooling water with associated level feeler or sensor.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE thereof schematically illustrates an exemplary embodiment of continuous casting installation suitable for the performance of the method aspects of this invention.

DETAILED DESCRIPTION OF THE PREFERRED EMBODIMENTS

Describing now the drawing, there will be considered an exemplary embodiment of continuous casting installation suitable for use in carrying out the method of this development, and wherein the metal to be cast, typically steel, supplied from a suitable casting or pouring vessel 2, for instance a tundish flows into a curved cooled continuous casting mold 1. For starting-up the continuous casting installation or machine the mold 1 is closed at its outlet end by any suitable and therefore not particularly illustrated dummy bar, as is well known in this particular art. The continuously cast strand 3 which possesses a liquid core and which is formed in the continuous casting mold 1 is withdrawn therefrom with the aid of the dummy bar by means which will be more fully considered hereinafter. A strand guide assembly or strand guide 4 which follows the continuous casting mold 1 and which guides the strand along a desired path of travel — in the embodiment under discussion along a circular arc-shaped path — into a horizontal path of travel, is subdivided into two regions or zones up to the location of the complete solidification of the strand, namely a first partial region or zone 5 which follows the continuous casting mold 1 and a second partial region or zone 6. The partial region or zone 5 consists of cooling means, here shown as cooling plates 10, for instance of the type disclosed in Swiss Pat. No. 456,859, corresponding to U.S. Pat. No. 3,399,716, and cooling grids 15, for instance of the type disclosed in German Pat. No. 2,143,962, corresponding to U.S. Pat. No. 3,753,459 the disclosure of which is incorporated herein and to which reference may be readily had.

The partial region or zone 6 of the strand guide assembly 4 is equipped with a compartment or chamber 20 which surrounds the cast strand 3. The end 20' of the compartment 20 which confronts the not particularly illustrated cutting unit is equipped with a labyrinth seal or sealing means 21 for reducing the pressure prevailing in the pressure or pressurized compartment 20 to the atmospheric pressure. The end 20'' of the pressure compartment 20 confronting the continuous casting mold 1 is provided with a seal 22. This seal or seal means 22 is constructed as a plate structure or plates and connected with the upstream arranged grid 15, wherein the last transverse guide of the grid extends such plate structure. In these extended plates 22 there are likewise mounted labyrinth compartments or chambers 22'. The plates 22 are provided with cooling compartments like the plates 10, hence possess a similar construction, yet are not equipped with any device for the direct cooling of the strand.

The compartment 20 is subdivided by partition walls 23 into different individual compartments or partial chambers 24, 25, 26 and 27. These individual or partial compartments 24 to 27 are provided at the outer side of the strand radius i.e., at the lower side or face of the strand, with guide rollers 28 which guide the strand 3 along a predetermined path of travel. However, such rollers 28 are also provided at the inside of the radius of the strand, that is to say, at the inside surface of the strand, and take-up the traction forces acting on the strand. Roller pairs 29, 30 and 31 form a withdrawal- and straightening device of known construction which conveys and linearly straightens the cast strand 3. Furthermore, an additional strand withdrawal assembly is arranged after the compartment 20. This assembly or unit also serves for the infeed of the dummy bar. Between the rollers 28 to 31, but also at the inner strand radius, there are arranged spray nozzles 32 of a device for the infeed of cooling water which further cools the strand 3. The individual compartment or chamber 24 furthermore possesses an outlet opening 40 for the water vapor which is formed and leading into the compartment 20. This outlet opening 40 is connected through the agency of a regulating or control valve 41 with a not particularly illustrated water vapor recirculation device for the condensation of the water vapor.

A collecting basin 24' to 27' for the not vaporized water, but also for the formed cinders or scale, is associated with each individual compartment or chamber 24 to 27. Each collecting vessel or basin 24' to 27' is equipped with a drain or dishcharge 33' having a motor valve 33. Each motor valve 33 is connected through the agency of a conductor 35 with an electric level feeler or sensor 34. As soon as the water at the relevant collecting basin has reached a predetermined level, then the motor valve 33 opens owing to its response to a signal transmitted by the feeler or sensor 34, so that the collected water which is admixed with the scale can drain or flow-off. As soon as the water level has reached a lower predetermined level then the valve 33 closes.

The continuous casting installation has associated therewith a device or means for generating compressed or pressurized air. In the embodiment under consideration such consists of a suitable blower, here shown as an axial blower 50 provided with a suitable electric motor 51. The pressurized air generated by the blower 50 is delivered to a storage vessel or reservoir 52. This storage vessel 52 is connected through the agency of a conduit 53 with devices for the infeed of the pressurized air into the individual compartments or chambers 24 to 27. One such device consists of an electromagnetic valve 60 with an associated air conduit 61 and an electric pressure feeler 62 which is electrically connected via a conductor or line 63 with the valve 60. Furthermore, the pressure feeler 62 is electrically connected via a conductor or line 64 with an associated motor valve 33. The pressure feeler 62 works with three threshold values, to wit, an intermediate threshold value, a lower threshold value and an upper threshold value. The upper threshold value is associated with the maximum pressure in the corresponding individual or partial compartment. Upon the occurrence of a maximum pressure signal there is opened an interrupter contact in the associated conductor or line 35, so that the signal of the associated level feeler 34 becomes ineffectual at the associated motor valve 33. Furthermore, the maximum pressure signal opens the motor valve 33. The lower threshold value is associated with a minimum pressure. Upon occurrence of the minimum pressure signal the electromagnetic valve 60 is opened. The intermediate threshold value generates a signal which renders ineffectual the signals of the minimum- and maximum pressures and closes the valves 33 and 60.

The heretofore described continuous casting installation, for instance when casting slabs of a dimension of 2000 × 250 mm. with a casting speed of 2 meters per minute, is operated as follows: for these conditions there is selected a machine radius of about 10 meters. The length of the partial zone or region 5 amounts to about 2 meters. The continuous casting mold 1 possesses a standard length of 0.8 meters. The cooling plate zone 10 following the continuous casting mold possesses a length of 0.5 meters. The cast strand 3 departing from the partial zone or region 5 has a solidified marginal zone of about 40 mm., in other words it is strong enough to prevent the occurrence of metal breakouts. At the pressure or pressurized compartment 20 i.e., in the individual compartments 24 to 27 the surface of the strand is subjected to the pressurized gaseous medium essentially consisting of water vapor, the vapor being generated by spraying the strand with water. The water emanating from the recirculation apparatus possesses a pressure which is greater, for instance, by 6 bars than the compartment pressure and is sprayed by the nozzles 32 onto the strand and partially vaporized. Consequently, the strand is further cooled. The pressure prevailing in the compartment 20 is different from one partial or individual compartment to the other partial or individual compartment, and essentially corresponds to the ferrostatic pressure prevailing at the corresponding strand section. The vapor generated in these individual compartments or chambers flows in the direction of the decreasing individual compartment pressure — the individual compartment walls are not sealed at the strand — in other words opposite to the movement of the strand and flows via the regulating valve 41 to the recirculation device or apparatus. The water which has not vaporized and which collects at the individual compartments 24 to 27 is withdrawn by means of the control valves 33, filtered and delivered to a pump which is part of the recirculation apparatus. Further details of the construction and operation of the pressure compartment have been set forth in the German Pat. No. 2,228,317, incorporated herein and to which reference may be readily had.

The pressurized air portion of the installation is operated as follows: for the selected radius of the installation the pressurized air portion is designed for a chamber or compartment pressure of 10 bars. When starting-up the casting operation with the installation cold or in a warm condition part of the dummy bar is located in the compartment 20. As soon as the dummy bar is located at the region of the seal 22 then the pressure feelers or sensors 62 are switched-on. Since all of the individual compartments 24 to 27 are without pressure, the associated valves 60 are opened and the pressurized air flows from the storage vessel 52 into the individual compartments. At the same time the spray nozzles 32 are also placed into operation. As soon as the hot strand 3 reaches the compartment 24 there is produced vapor and the pressure in the individual compartment 24 increases. Depending upon the increase in pressure the pressure feeler 62 switches-on or switches-off the associated valve 60, and specifically for such length of time until the waste heat of the strand can maintain the necessary pressure. In this condition the valve 60 remains closed. The other individual compartments 25 to 27 are placed into operation in the same manner. If the entire compartment 20 no longer requires any pressurized air then the axial blower 50 is automatically shutdown.

During disturbances in the casting operation or upon the occurrence of the previously mentioned changes in such casting operation, which require a reduced transfer of heat of the strand, upon a pressure drop in one or a number of the individual compartments or chambers there is automatically further supplied pressurized air until the deviations from the required or predetermined vapor pressure are compensated. The storage vessel 52 is designed such that there is available the required pressure until there occurs the complete delivery of the pressurized air by means of the axial blower 50 which begins to run.

Upon reaching the predetermined water level in the corresponding collecting basin the associated motor valve 33 opens. In the event that the pressure in the associated individual compartment or chamber drops, then the minimum pressure signal of the pressure feeler 62 opens the valve 60 and the pressure drop is compensated for such length of time until the level feeler or sensor 34 has reached its lower level and the motor valve 33 closes.

If an excess pressure prevails in an individual compartment or chamber, then the associated motor valve 33 opens for such length of time until the deviation from the required vapor pressure is compensated. The upper threshold value of each pressure feeler 62 renders the signal of the level feeler 34 ineffectual, so that independent of the water level in the collecting basin — even if no water level is present longer —longer— the motor valve remains opened.

In the described installation the strand guide section which follows the continuous casting mold is provided with a mechanical support, whereas the pressure component or portion of the equipment only begins thereafter. This pressure component can also, however, extend up to the region of the mold.

The described invention also can be employed at an installation having a straight or linear mold as well as at inclined or horizontally arranged molds.

While there is shown and described present preferred embodiments of the invention, it is to be distinctly understood that the invention is not limited thereto, but may be otherwise variously embodied and practiced within the scope of the following claims.

Accordingly, what is claimed is:

1. A method of operating a continuous casting installation with high throughput, wherein the steel is cast into a cooled mold, the strand which is formed in the mold possessing a liquid core and such strand is withdrawn from the mold, guided and cooled, the improvement comprising the steps of: subjecting the surface of the strand to the action of a pressurized gaseous medium, primarily in the form of water vapor, at least at a partial region between the mold and the point of complete solidification of the strand, the pressure of the gaseous medium essentially corresponding to the ferrostatic pressure prevailing at the cast strand, the water vapor being generated by spraying the surface of the strand with water, compensating deviations of the vapor pressure from a required vapor pressure, and upon falling below the required vapor pressure the difference therefrom is compensated by the infeed of pressurized air.

2. A method of operating a continuous casting installation with high throughput, wherein the steel is cast into a cooled mold, the strand which is formed in the mold possessing a liquid core and such strand is withdrawn from the mold, guided and cooled, the improvement comprising the steps of: subjecting the surface of the strand to the action of a pressurized gaseous medium, primarily in the form of water vapor, at least at a partial region between the mold and the point of complete solidification of the strand, the pressure of the gaseous medium essentially corresponding to the ferrostatic pressure prevailing at the cast strand, the water vapor being generated by spraying the surface of the strand with water, compensating deviations of the vapor pressure from a required vapor pressure, and upon exceeding the required vapor pressure the difference therefrom is compensated by lowering the level of cooling water located in a collecting basin.

3. The method as defined in claim 2, further including the step wherein upon exceeding the required vapor pressure shutting-off a level feeler which senses the level of cooling water located in the collecting basin.

4. A method of operating a continuous casting installation with high throughput, wherein the steel is cast into a cooled mold, the strand which is formed in the mold possessing a liquid core and such strand is withdrawn from the mold, guided and cooled, the improvement comprising the steps of: subjecting the surface of the strand to the action of a pressurized gaseous medium, primarily in the form of water vapor, at least at a partial region between the mold and the point of complete solidification of the strand, the pressure of the gaseous medium essentially corresponding to the ferrostatic pressure prevailing at the cast strand, the water vapor being generated by spraying the surface of the strand with water, compensating deviations of the vapor pressure from a required vapor pressure, and rendering ineffectual the signal of a level feeler which senses the level of cooling water located in a collecting basin upon exceeding the vapor pressure and which signal when effectual opens a motor valve for draining the collecting basin.

5. A method of operating a continuous casting installation with high throughput, wherein the steel is cast into a cooled mold, the strand which is formed in the mold possessing a liquid core and such strand is withdrawn from the mold, guided and cooled, the improvement comprising the steps of: subjecting the surface of the strand to the action of a pressurized gaseous medium, primarily in the form of water vapor, at least at a partial region between the mold and the point of complete solidification of the strand, the pressure of the gaseous medium essentially corresponding to the ferrostatic pressure prevailing at the cast strand, the water vapor being generated by spraying the surface of the strand with water, compensating deviations of the vapor pressure from a required vapor pressure, upon exceeding the required vapor pressure switching-off a level feeler which senses the level of cooling water located in a collecting basin, opening a motor valve for venting excess pressure from the collecting basin, and upon reaching the required vapor pressure reclosing the motor valve and again switching-on the level feeler.

* * * * *